US011106162B2

(12) United States Patent
Mizoguchi

(10) Patent No.: US 11,106,162 B2
(45) Date of Patent: Aug. 31, 2021

(54) IMAGE FORMING APPARATUS AND CONVEYANCE CONTROL METHOD

(71) Applicant: Konica Minolta Inc., Tokyo (JP)

(72) Inventor: Shuri Mizoguchi, Kunitachi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/993,359

(22) Filed: Aug. 14, 2020

(65) Prior Publication Data

US 2021/0063917 A1 Mar. 4, 2021

(30) Foreign Application Priority Data

Aug. 27, 2019 (JP) ..... JP2019-154644

(51) Int. Cl.
*G03G 15/16* (2006.01)
*G03G 15/00* (2006.01)

(52) U.S. Cl.
CPC ..... *G03G 15/165* (2013.01); *G03G 15/1605* (2013.01); *G03G 15/167* (2013.01); *G03G 15/657* (2013.01); *G03G 15/6567* (2013.01); *G03G 2215/00409* (2013.01)

(58) Field of Classification Search
CPC ..... G03G 15/165; G03G 15/1665; G03G 15/167; G03G 15/1605; G03G 15/1695; G03G 15/6558; G03G 15/6561; G03G 15/6564; G03G 15/6567; G03G 2215/00405; G03G 2215/00409; G03G 2215/00561; G03G 2215/00565; B41J 13/0009; B41J 13/0027; B41J 13/14; B41J 13/32; B41J 25/003; B41J 11/0035; B41J 11/0045; B41J 11/005; B41J 11/007; B41J 11/008; B41J 11/42; B41J 11/44

See application file for complete search history.

(56) References Cited

U.S. PATENT DOCUMENTS 5,241,348 A * 8/1993 Garavuso ..... G03G 15/04 399/322
6,895,210 B1 * 5/2005 Quesnel ..... G03G 15/5029 399/395
7,596,334 B2 * 9/2009 Yoshino ..... G03G 15/2028 399/122
2005/0031384 A1 * 2/2005 Sohmiya ..... G03G 15/167 399/309
2007/0182089 A1 * 8/2007 Kawashima ..... B65H 9/166 271/164
2008/0056780 A1 * 3/2008 Nishida ..... G03G 15/165 399/316
2013/0093810 A1 * 4/2013 Suzuki ..... B41J 2/0057 347/10

(Continued)

FOREIGN PATENT DOCUMENTS

JP 2006-085153 A 3/2006

*Primary Examiner* — Carla J Therrien
(74) *Attorney, Agent, or Firm* — Lucas & Mercanti, LLP

(57) ABSTRACT

An image forming apparatus includes: a conveyer that conveys a recording medium; a transfer part that forms a transfer nip between with the conveyer, and conveys, toward the transfer nip, an image to be transferred onto the recording medium; and an inclination part that inclines the recording medium conveyed by the conveyer with respect to a conveyance direction of the recording medium in the conveyer.

16 Claims, 12 Drawing Sheets

(56) References Cited

U.S. PATENT DOCUMENTS

| | | | | |
|---|---|---|---|---|
| 2017/0088375 | A1* | 3/2017 | Matsumoto | B65H 5/062 |
| 2018/0152576 | A1* | 5/2018 | Arai | G03G 15/6555 |
| 2019/0023511 | A1* | 1/2019 | Ishioka | B65H 5/062 |
| 2019/0025749 | A1* | 1/2019 | Iwasaki | G03G 15/1615 |
| 2019/0330000 | A1* | 10/2019 | Gesner | B65H 9/12 |
| 2019/0330001 | A1* | 10/2019 | Matsuda | G03G 15/6561 |

* cited by examiner

IMAGE FORMING APPARATUS AND CONVEYANCE CONTROL METHOD

The entire disclosure of Japanese patent Application No. 2019-154644, filed on Aug. 27, 2019, is incorporated herein by reference in its entirety.

BACKGROUND

Technological Field

The present invention relates to an image forming apparatus and a conveyance control method.

Description of the Related Art

Conventionally, there is known an image forming apparatus including: a conveyer that conveys a recording medium; and a transfer part that forms a transfer nip between with the conveyer, and conveys, toward the transfer nip, an image to be transferred onto the recording medium. In such an image forming apparatus, when the recording medium enters the transfer nip or leaves the transfer nip, a load fluctuation occurs in the transfer part at the transfer nip portion, so that a conveyance speed of the transfer part becomes uneven. Then, if a timing of image formation at an image forming portion in the transfer part and a timing of the recording medium passing through the transfer nip become the same, the image in the image formation may be disturbed.

For example, JP 2006-85153 A discloses a configuration in which a drive current of a drive source is set larger than usual, based on a transient load fluctuation torque generated when a recording medium enters or leaves a transfer nip (pressurizing contact part) portion.

However, since there are various types of recording media that pass through the transfer nip, a fluctuation amount of a load at the transfer nip portion also fluctuates depending on the type of recording medium. Therefore, in the configuration described in JP 2006-85153 A, it may not be possible to completely alleviate an occurrence of unevenness in a conveyance speed of the transfer part due to the recording medium passing through the transfer nip. Further, an apparatus can also be designed such that the recording medium does not pass through the transfer nip when an image is being formed on the transfer part, but there is a possibility that a distance from the image forming portion to the transfer nip in the transfer part becomes long, and eventually the apparatus becomes large.

SUMMARY

An object of the present invention is to provide an image forming apparatus and a conveyance control method capable of suppressing an occurrence of unevenness in a conveyance speed of a transfer part due to a load fluctuation when a recording medium passes through a transfer nip.

To achieve the abovementioned object, according to an aspect of the present invention, an image forming apparatus reflecting one aspect of the present invention comprises: a conveyer that conveys a recording medium; a transfer part that forms a transfer nip between with the conveyer, and conveys, toward the transfer nip, an image to be transferred onto the recording medium; and an inclination part that inclines the recording medium conveyed by the conveyer with respect to a conveyance direction of the recording medium in the conveyer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
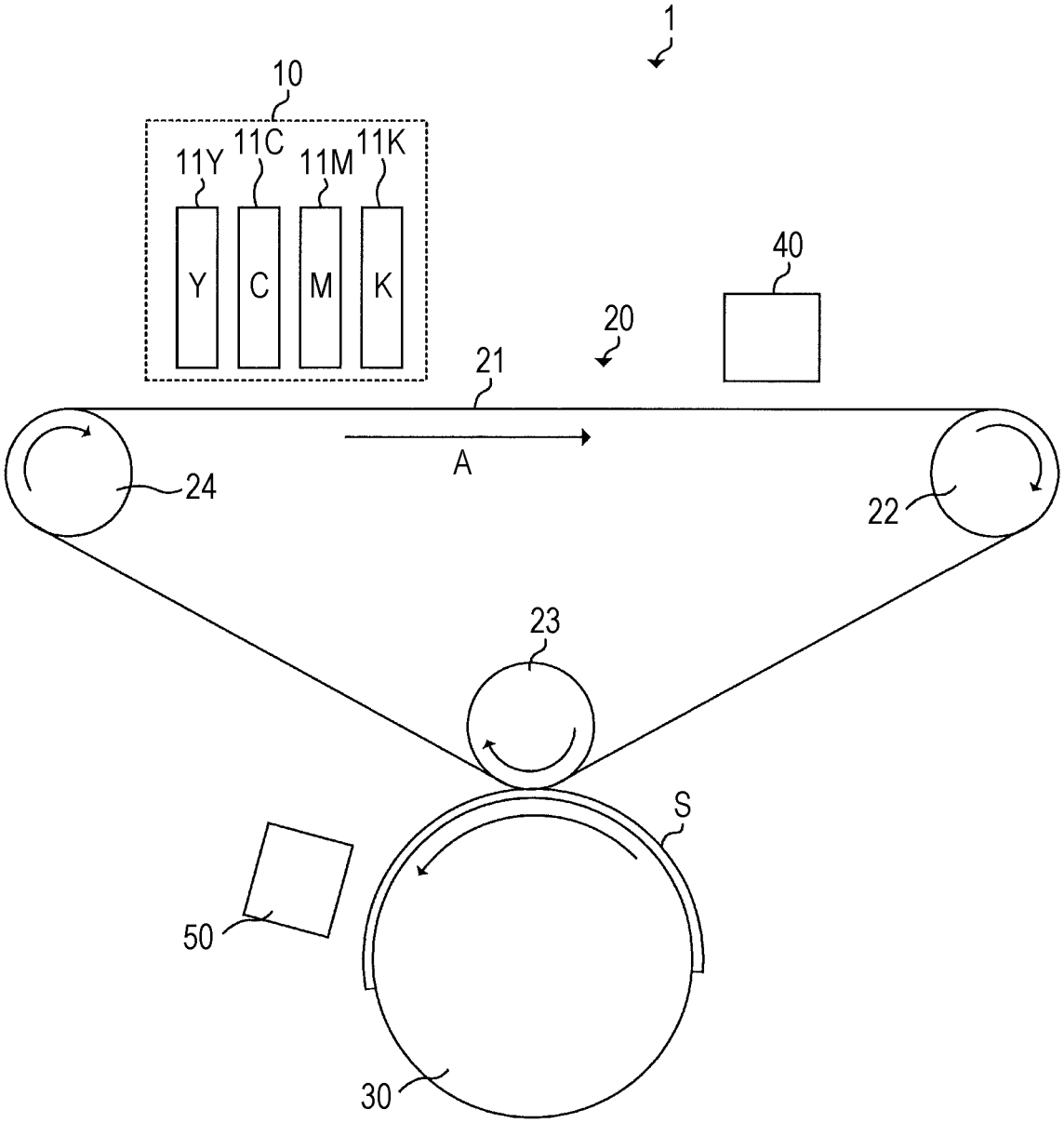
FIG. 1 is a view schematically showing an overall configuration of an image forming apparatus according to an embodiment of the present invention.
Figure 2:
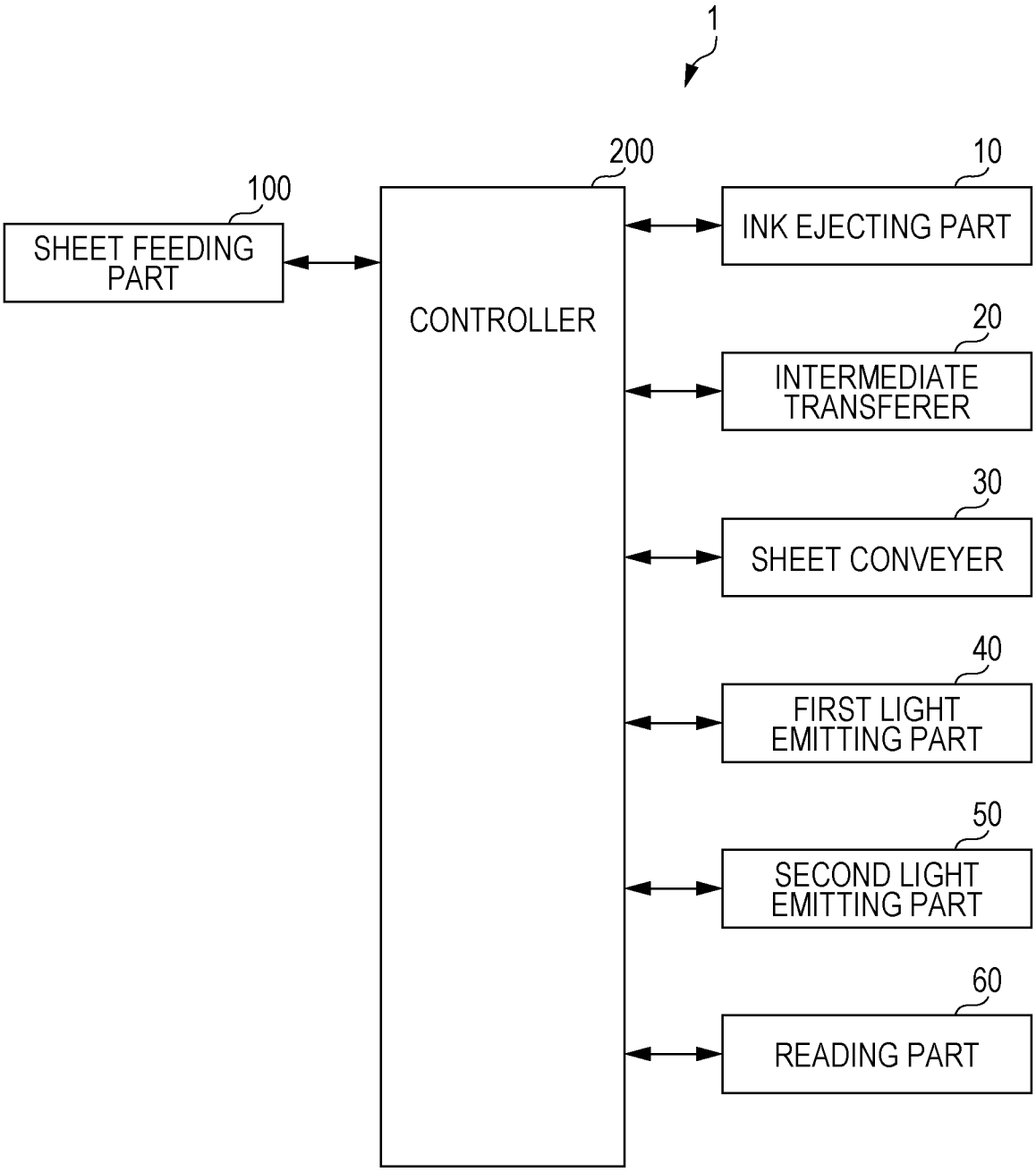
FIG. 2 is a diagram showing a main part of a control system of the image forming apparatus according to the present embodiment.

Hereinafter, one or more embodiments of the present invention will be described with reference to the drawings. However, the scope of the invention is not limited to the disclosed embodiments. FIG. 1 is a view schematically showing an overall configuration of an image forming apparatus 1 according to an embodiment of the present invention. FIG. 2 is a diagram showing a main part of a control system of the image forming apparatus 1 according to the present embodiment.

As shown in FIGS. 1 and 2, the image forming apparatus 1 is an intermediate-transfer color image forming apparatus that forms an image based on an inkjet method. The image forming apparatus 1 includes an ink ejecting part 10, an intermediate transferer 20, a sheet conveyer 30, a first light emitting part 40, a second light emitting part 50, a reading part 60, and a sheet feeding part 100, and a controller 200 (see FIG. 2).

As shown in FIG. 2, the controller 200 includes a central processing unit (CPU), a read only memory (ROM), a random access memory (RAM), and the like. The CPU reads a program according to processing contents from the ROM, develops the program in the RAM, and cooperates with the developed program to centrally control an operation of each block and the like of the image forming apparatus 1. At this time, various data stored in a storage unit (not shown) are referred to. The storage unit (not shown) is formed by, for example, a non-volatile semiconductor memory (so-called flash memory) or a hard disk drive.

As shown in FIG. 1, the ink ejecting part 10 includes inkjet heads 11Y, 11C, 11M, and 11K, and ejects individual color ink of yellow (Y), magenta (M), cyan (C), and black (K) onto the intermediate transferer 20, to form an image based on the ink. The ink ejecting part 10 corresponds to an "image former" of the present invention. Since the inkjet heads 11Y, 11C, 11M, and 11K have a similar configuration, Y, M, C, and K will be omitted in the following description for convenience.

The intermediate transferer 20 has an intermediate transfer belt 21 as an example of a transfer part, and three support rollers 22, 23, and 24. The intermediate transfer belt 21 is formed by an endless belt member, and is stretched around the three support rollers 22, 23, and 24 in an inverted triangular shape.

At least one of the three support rollers 22, 23, and 24 is a drive roller, and is driven under control of the controller 200. This causes the intermediate transfer belt 21 to rotate in an A direction (clockwise direction in FIG. 1).

In the intermediate transfer belt 21, a portion stretched by the support rollers 22 and 24 located at left and right apexes of the inverted triangle is a landing surface of the ink ejected from the inkjet head 11. In the intermediate transfer belt 21, the support roller 23 located at a lower apex of the inverted triangle is a pressure roller that presses the intermediate transfer belt 21 toward the sheet conveyer 30 with a predetermined nip pressure.

The sheet conveyer 30 is formed by a metal drum, and is pressed by the support roller 23 to form a transfer nip. The sheet conveyer 30 has a claw (not shown) that fixes a leading end of a sheet S. Under control of the controller 200, the sheet conveyer 30 fixes the leading end of the sheet S to the claw, and rotates in the counterclockwise direction in FIG. 1 to convey the sheet S as an example of a recording medium, to the transfer nip.

The first light emitting part 40 faces the ink landing surface of the intermediate transfer belt 21 on a downstream side of the ink ejecting part 10. The first light emitting part 40 emits light on an image formed on the intermediate transfer belt 21 to pre-cure the image.

The second light emitting part 50 faces a downstream side portion of the transfer nip in the sheet conveyer 30, and emits light on the image on the sheet S to fully cure the image.

The reading part 60 is a sensor (for example, a line sensor) that can detect an edge of a sheet, and is provided in a conveying path part (not shown) provided between the sheet feeding part 100 and the sheet conveyer 30.

An image formed on a front surface of the intermediate transfer belt 21 by the inkjet head 11 is pre-cured by the first light emitting part 40 as the intermediate transfer belt 21 rotates, and is conveyed to the transfer nip between the support roller 23 and the sheet conveyer 30. Then, the image conveyed to the transfer nip is transferred to the sheet S conveyed by the sheet conveyer 30. The image transferred onto the sheet S is fully cured by the second light emitting part 50.

Figure 3:
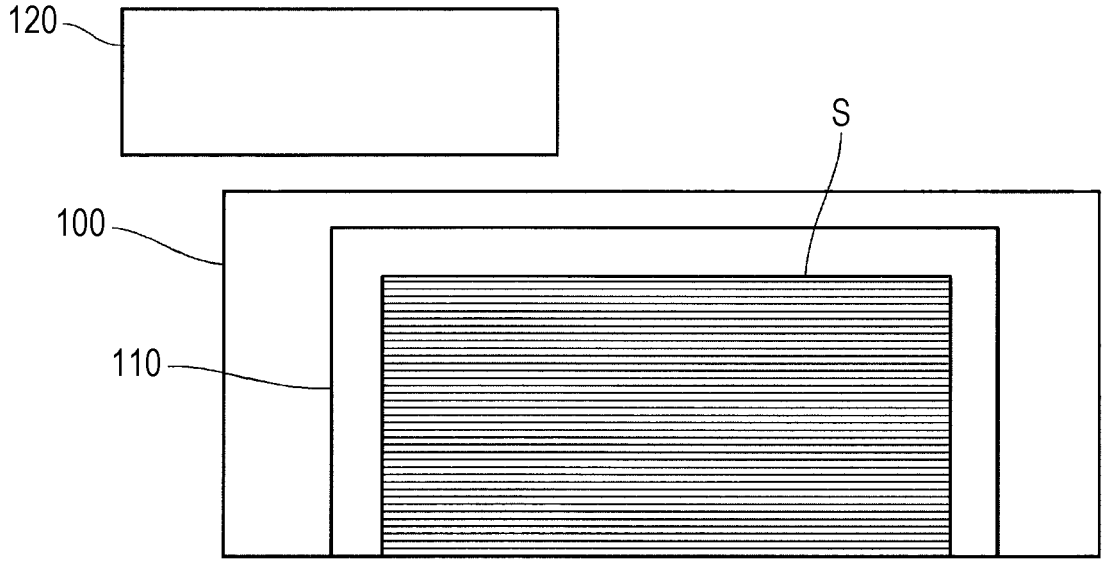
FIG. 3 is a view schematically showing a configuration of a sheet feeding part.

The sheet feeding part 100 is a sheet feeding device that feeds the sheet S to the sheet conveyer 30 under control of the controller 200. As shown in FIG. 3, the sheet feeding part 100 includes an accommodation part 110 and a supply part 120.

The accommodation part 110 is formed to be able to accommodate a large amount of sheets S. The supply part 120 is arranged above the accommodation part 110, separates the uppermost sheet S in the accommodation part 110, and supplies the separated sheet S to the sheet conveyer 30.

Figure 4:
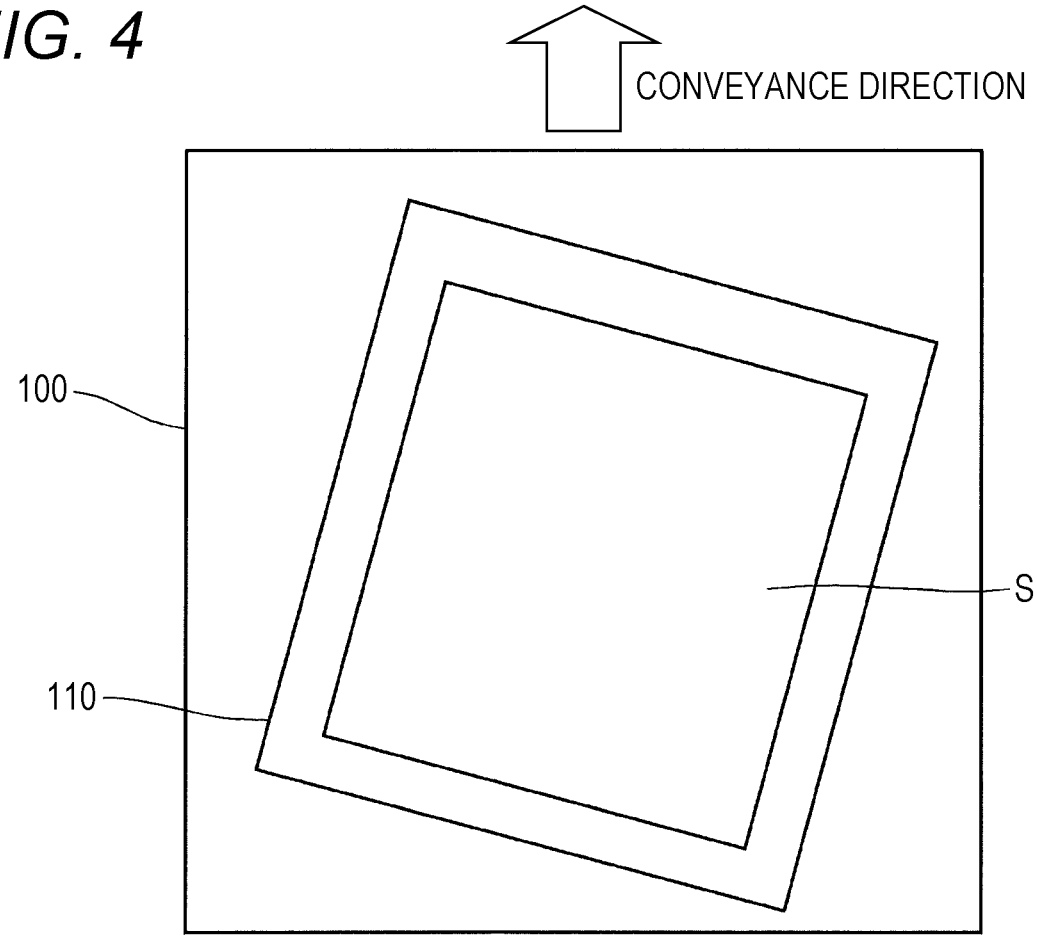
FIG. 4 is a view showing a state of an arrangement of an accommodation part.

Further, as shown in FIG. 4, the accommodation part 110 is configured such that arrangement inside the sheet feeding part 100 can be changed. Specifically, the accommodation part 110 is made capable of being arranged with inclination with respect to a conveyance direction of the sheet S in the sheet conveyer 30.

By arranging the accommodation part 110 with inclination, the sheet S in the accommodation part 110 is conveyed in a state of being inclined with respect to the conveyance direction. In other words, the sheet feeding part 100 inclines the sheet S conveyed by the sheet conveyer 30 with respect to the conveyance direction of the sheet S in the sheet conveyer 30. The sheet feeding part 100 corresponds to an "inclination part" according to the present invention.

The sheet S in such an inclined state is conveyed by the sheet conveyer 30 and enters the transfer nip while maintaining this state.

Meanwhile, since the intermediate transfer belt 21 runs over the sheet S when the sheet S enters the transfer nip, a load fluctuation occurs in the intermediate transfer belt 21 and the sheet conveyer 30 at the transfer nip portion, and a conveyance speed of the intermediate transfer belt 21 becomes uneven.

Figure 5:
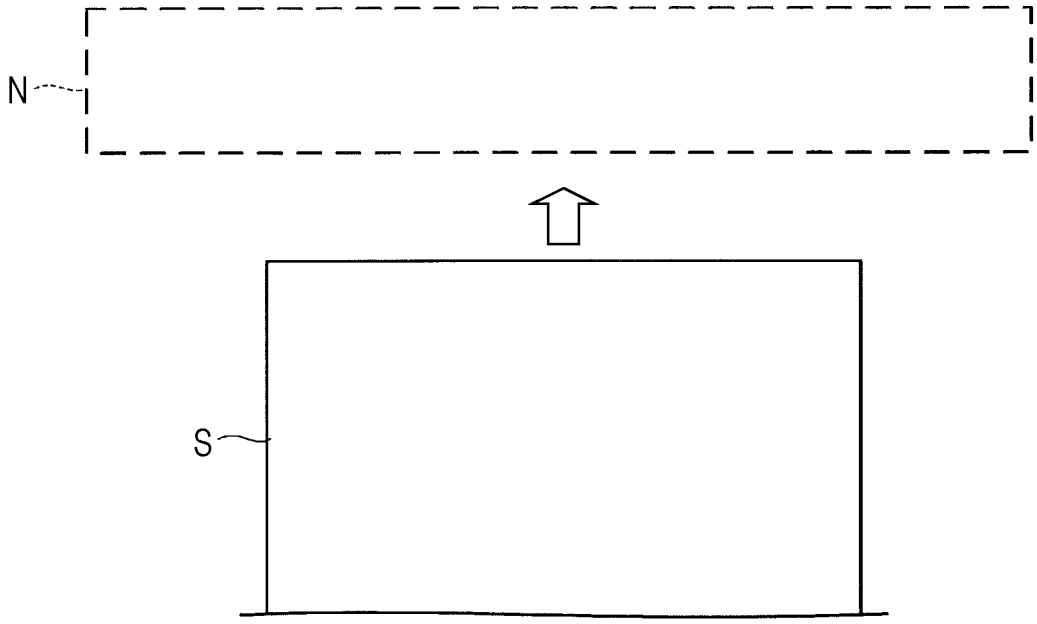
FIG. 5 is a view showing a state where a sheet that is not inclined with respect to a conveyance direction enters a transfer nip.

For example, as shown in FIG. 5, when the sheet S that is not inclined with respect to the conveyance direction, that is, the sheet S whose long sides are substantially parallel to the conveyance direction is conveyed by the sheet conveyer 30, the entire short side portion of the sheet S enters a transfer nip N at substantially the same timing.

Then, in the transfer nip N, a portion corresponding to the entire short side portion of the sheet S collides with the intermediate transfer belt 21 at substantially the same timing, which increases a load fluctuation of the entire transfer nip N, and causes unevenness of a conveyance speed of the intermediate transfer belt 21. As a result, when an image is being formed by the ink ejecting part 10 at that timing, the image may be disturbed.

Figure 6:
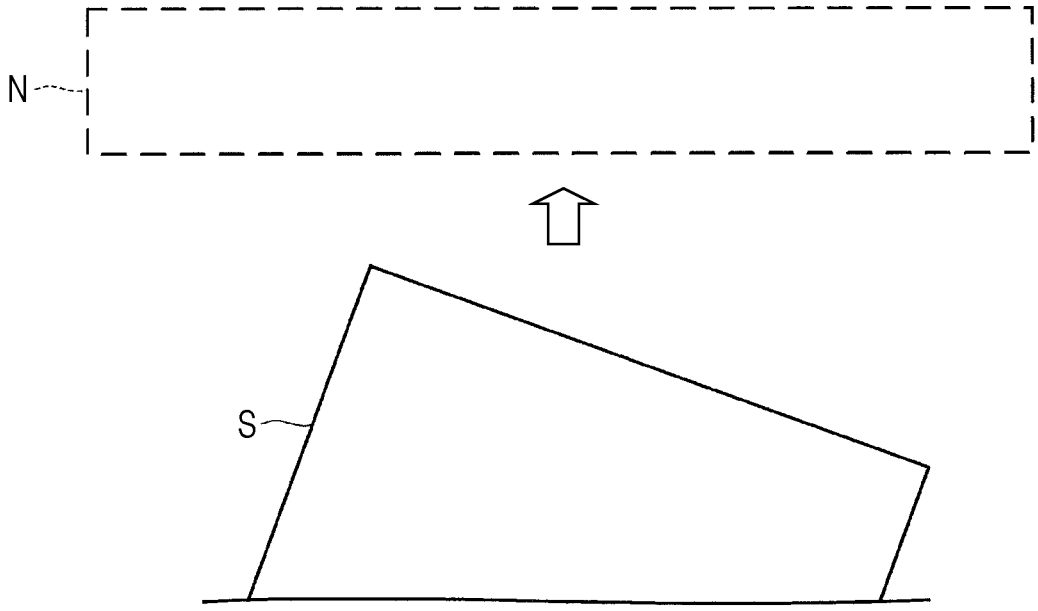
FIG. 6 is a view showing a state where a sheet that is inclined with respect to a conveyance direction enters the transfer nip.

Whereas, in the present embodiment, as shown in FIG. 6, since the sheet S in a state of being inclined with respect to the conveyance direction is conveyed, the sheet S enters the transfer nip N from a corner of the sheet S. Then, at the timing when the sheet S enters the transfer nip N, in the transfer nip N, a portion corresponding to the corner of the sheet S exclusively collides with the intermediate transfer belt 21.

This makes it possible to reduce a fluctuation amount of a load in the entire transfer nip N as compared with the sheet S that is not inclined. This can reduce unevenness in the conveyance speed of the intermediate transfer belt 21 due to the load fluctuation. As a result, even when an image is being formed by the ink ejecting part 10 at the timing when the sheet S reaches the transfer nip N, it is possible to suppress disturbance on the image.

Figure 7:
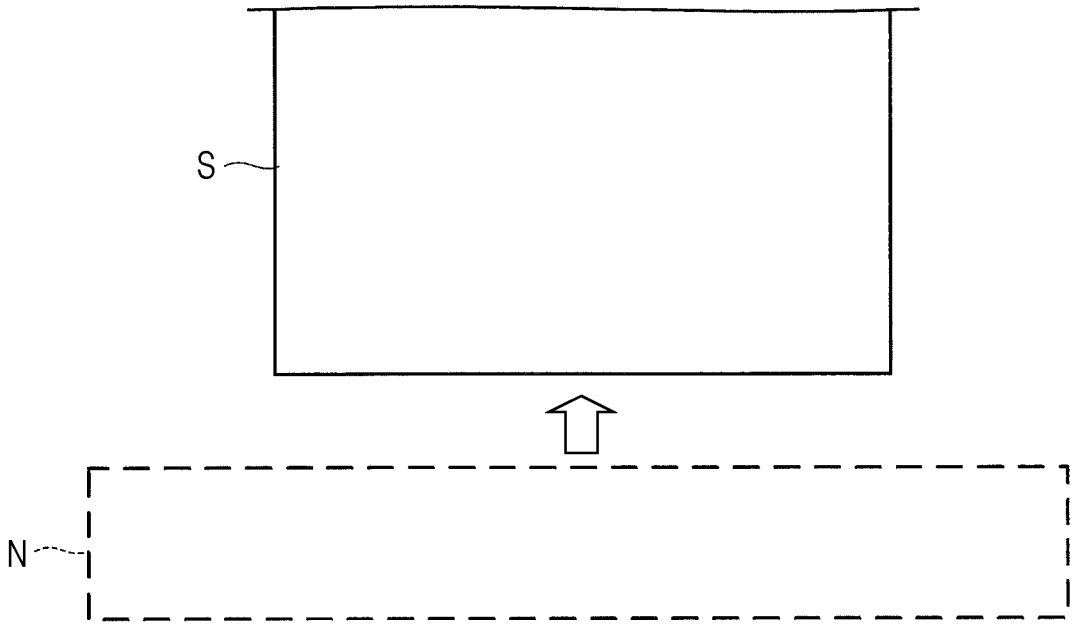
FIG. 7 is a view showing a state where a sheet that is not inclined with respect to a conveyance direction leaves the transfer nip.

Further, as shown in FIG. 7, when the sheet S leaves the transfer nip N, the intermediate transfer belt 21 is lowered by a thickness of the sheet S. This causes a load fluctuation in the intermediate transfer belt 21 and the sheet conveyer 30 at a portion of the transfer nip N similarly to when the sheet S enters the transfer nip.

Therefore, when the sheet S that is not inclined with respect to the conveyance direction leaves the transfer nip N, the entire short side portion of the sheet S leaves the transfer nip N at substantially the same timing. Then, in the transfer nip N, a portion corresponding to the entire short side portion of the sheet S receives a load at substantially the same timing, which increases a load fluctuation of the entire transfer nip N, and causes unevenness of a conveyance speed of the intermediate transfer belt 21. As a result, when an image is being formed by the ink ejecting part 10 at that timing, the image may be disturbed.

Figure 8:
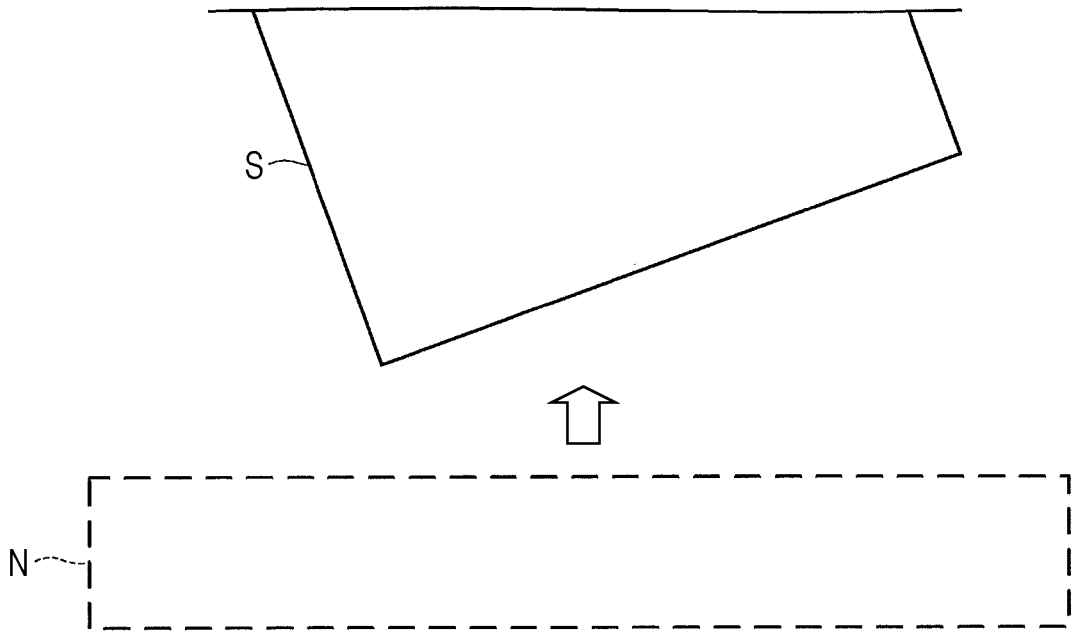
FIG. 8 is a view showing a state where a sheet that is inclined with respect to a conveyance direction leaves the transfer nip.

Whereas, as shown in FIG. 8, in the present embodiment, since the sheet S leaves the transfer nip N at a corner, a portion corresponding to the corner of the sheet S exclusively receives the load. This makes it possible to reduce a fluctuation amount of a load applied to the entire transfer nip N as compared with the sheet S that is not inclined. This can reduce unevenness in the conveyance speed of the intermediate transfer belt 21 due to the load fluctuation. As a result, even when an image is being formed by the ink ejecting part 10 at the timing when the sheet S reaches the transfer nip N, it is possible to suppress disturbance on the image.

Figure 9:
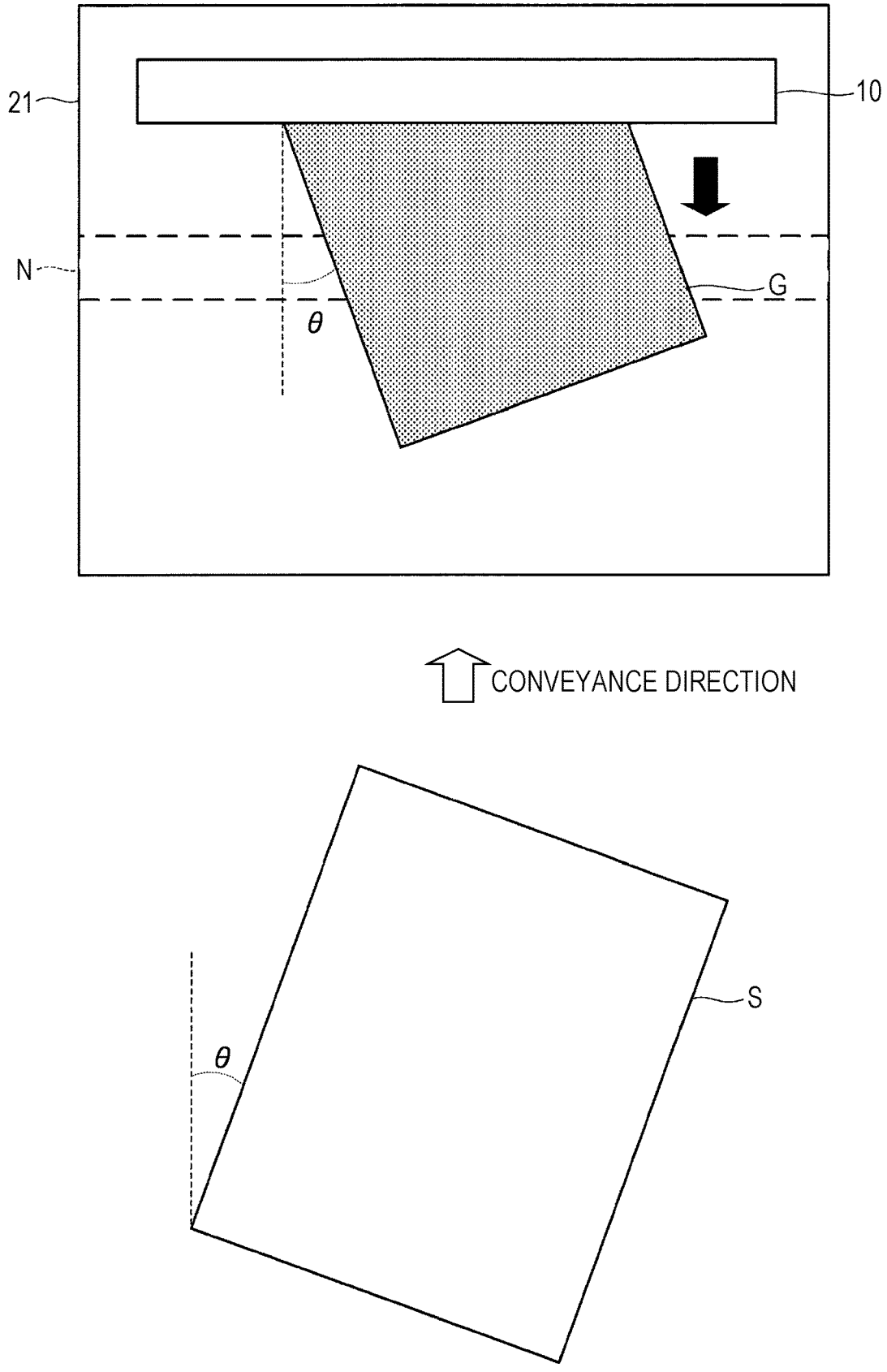
FIG. 9 is a view showing a state where an image is formed on an intermediate transfer belt.

Further, as shown in FIG. 9, in accordance with orientation of the sheet S inclined by the sheet feeding part 100, the controller 200 controls the ink ejecting part 10 such that an image G is formed with inclination on the intermediate transfer belt 21. Specifically, the controller 200 controls the ink ejecting part 10 so as to form the image G on the intermediate transfer belt 21 at an inclination angle that is the same as an inclination angle of the sheet S inclined by the sheet feeding part 100 with respect to the conveyance direction.

Figure 10:
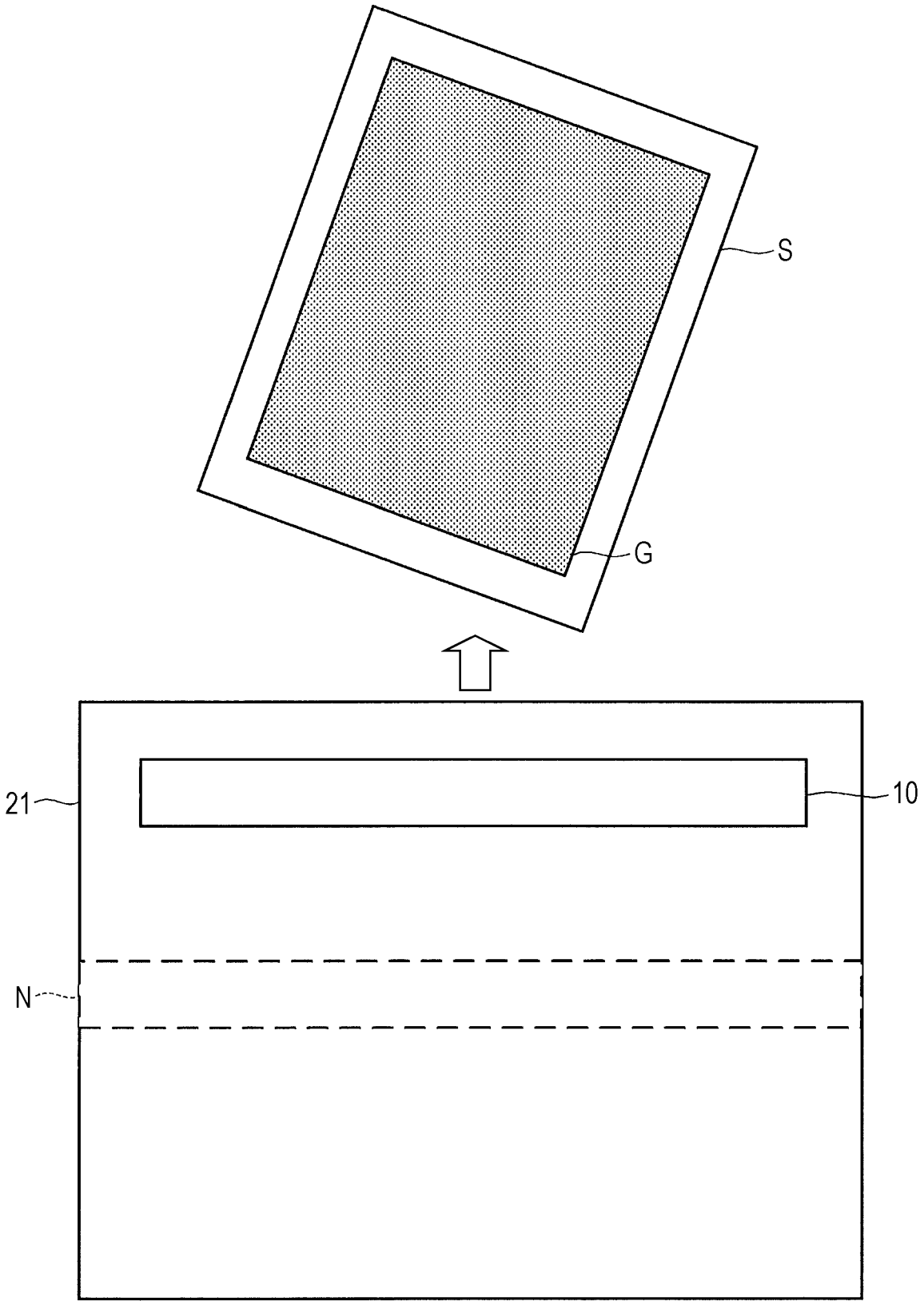
FIG. 10 is a view showing a state where the image shown in FIG. 9 is formed on a sheet.

FIGS. 9 and 10 are views of the intermediate transfer belt 21 shown in FIG. 1 viewed from above. Further, in FIG. 9, an inclination angle of the sheet S with respect to the conveyance direction is 0.

This causes the image G to be formed on the intermediate transfer belt 21 in a state where the image G is inclined in accordance with orientation of the sheet S that is conveyed with inclination. Therefore, as shown in FIG. 10, after the sheet S passes through the transfer nip N, the image G is formed at an appropriate position on the sheet S.

For example, in the ink ejecting part 10, when an image is formed on the intermediate transfer belt 21 without inclination, an image is not to be formed at an appropriate position on the sheet S since the sheet S is conveyed while being inclined.

Whereas, in the present embodiment, on the intermediate transfer belt 21, the image G is formed in a state of being inclined in accordance with orientation of the sheet S, which allows the image G to be formed at an appropriate position on the sheet S.

Further, in the sheet feeding part 100, an inclination angle of the sheet S may be set to increase as at least one of a basis weight or a thickness of the sheet S increases. An angle of the accommodation part 110 may be adjusted by control of the controller 200 or may be adjusted by a user operation.

If the sheet S has a large basis weight or the sheet S has a large thickness, a contact portion of the sheet S in the transfer nip is required to be as small as possible since a load fluctuation in the transfer nip is likely to be large.

Therefore, by increasing the inclination angle of the sheet S as at least one of the basis weight or the thickness of the sheet S increases, the contact portion with the sheet S in the transfer nip can be made as small as possible, and thus the load fluctuation in the transfer nip can be reduced.

Figure 11:
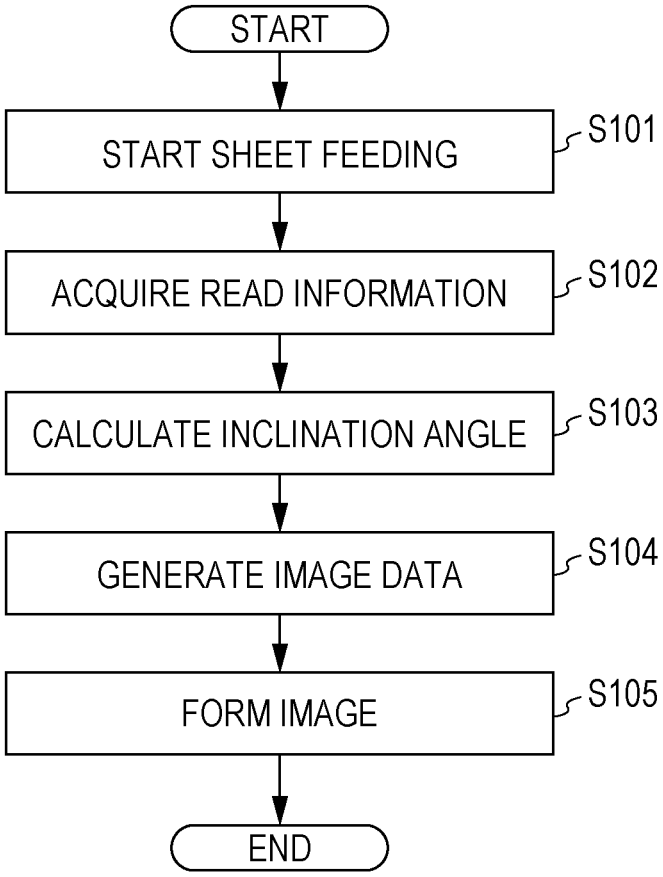
FIG. 11 is a flowchart showing an example of image formation control in a controller.

Next, an operation example of image formation control in the controller 200 will be described. FIG. 11 is a flowchart showing an example of an operation example of image formation control in the controller 200. This control is executed, for example, when the controller 200 receives a print job execution command.

As shown in FIG. 11, the controller 200 starts sheet feeding (step S101). At this time, in a configuration in which the controller 200 arranges the accommodation part 110 with inclination, the controller 200 inclines the accommodation part 110. Next, the controller 200 acquires read information of the sheet S from the reading part 60 (step S102).

After acquiring the read information of the sheet S, the controller 200 calculates an inclination angle of the sheet S on the basis of the read information (step S103). Then, the controller 200 generates image data on the basis of the calculated inclination angle (step S104).

After generating the image data, the controller 200 forms an image on the intermediate transfer belt 21 on the basis of the image data (step S105). After step S105, this control ends.

According to the present embodiment configured as described above, since the sheet S in a state of being inclined with respect to the conveyance direction is conveyed, the sheet S enters the transfer nip from a corner. Then, at the timing when the sheet S enters the transfer nip, in the transfer nip, a portion corresponding to the corner of the sheet S exclusively collides with the intermediate transfer belt 21.

This makes it possible to reduce a fluctuation amount of a load applied to the entire transfer nip as compared with the sheet S that is not inclined. This can reduce unevenness in the conveyance speed of the intermediate transfer belt 21 due to the load fluctuation. As a result, even when an image is being formed by the ink ejecting part 10 at the timing when the sheet S reaches the transfer nip, it is possible to suppress disturbance on the image.

Further, since the sheet S leaves the transfer nip at a corner, a portion corresponding to the corner of the sheet S exclusively receives the load. This makes it possible to reduce a fluctuation amount of a load applied to the entire transfer nip as compared with the sheet S that is not inclined. This can reduce unevenness in the conveyance speed of the intermediate transfer belt 21 due to the load fluctuation. As a result, even when an image is being formed by the ink ejecting part 10 at the timing when the sheet S reaches the transfer nip, it is possible to suppress disturbance on the image.

Meanwhile, in the configuration in which the entire short side portion of the sheet enters the transfer nip, the entire short side portion collides with the intermediate transfer belt 21 at the transfer nip. In this case, since a degree of impact due to the collision varies depending on a type of sheet, it may not be possible to completely mitigate image disturbance even if a drive current in the transfer part is changed.

Whereas, in the present embodiment, since the sheet is made to enter the transfer nip from a corner, a fluctuation amount in a load applied to the entire transfer nip can be reduced even when the type of sheet is different, as compared with the configuration in which the entire short side of the sheet enters the transfer nip. As a result, it is possible to reduce an occurrence of image disturbance as compared with the configuration in which the entire short side of the sheet enters the transfer nip. Further, since it is not required to increase a drive current in the intermediate transferer 20, a current consumption can be reduced as compared with the configuration in which the drive current is changed.

Further, even when an image is being formed by the ink ejecting part 10, unevenness in a conveyance speed of the intermediate transfer belt 21 is unlikely to occur, so that a transfer timing and an image forming timing can be made at the same time. As a result, productivity of the image forming apparatus 1 can be improved.

Further, since the transfer timing and the image forming timing can be made at the same time, there is no need to increase a distance between the image forming portion and the transfer nip, which enables a compact apparatus.

Further, on the intermediate transfer belt 21, the image G is formed in a state of being inclined in accordance with orientation of the sheet S, which allows the image G to be formed at an appropriate position on the sheet S.

Further, since the image is formed with inclination on the intermediate transfer belt 21, it is not required to simultaneously drive the ink ejecting part 10 in the entire width direction at a start of image formation in the ink ejecting part 10. If the ink ejecting part 10 is simultaneously driven in the width direction at the start of image formation, a load on a drive system of the ink ejecting parts 10 increases. When the load concentrates and increases on the drive system, a voltage drop occurs in the drive system, and an ejection amount in the ink ejecting part 10 varies. However, in the present embodiment, at the start of image formation, the ink ejecting part 10 is not simultaneously driven in the entire width direction. As a result, it is possible to suppress an increase of the load on the drive system of the ink ejecting part 10.

Further, since the nozzles that form thin lines parallel or perpendicular to a side end of the sheet S are dispersed by forming the image with inclination, it is possible to reduce missing of the image even if a defect of the nozzle occurs, for example.

Note that, in the above-described embodiment, the accommodation part 110 can be arranged with inclination, but the present invention is not limited to this. For example, the sheet feeding part 100 itself may be arranged with inclination with respect to the conveyance direction, or the sheet S may be held with inclination in the accommodation part 110.

Further, the sheet S may be inclined when the sheet S is separated by the supply part 120. For example, a configuration is assumed in which the supply part 120 has a separating member that sucks and separates one sheet S from a bundle of sheets S, and the separating member can be driven in an oblique direction. The sheet S may be inclined by driving this separating member in the oblique direction. Further, a configuration is assumed in which the supply part 120 separates the sheet S from the bundle of sheets S by air. In this configuration, the sheet S may be inclined by varying an amount of air blown onto the sheet S on one side edge and the other side edge.

Further, in the above-described embodiment, the sheet feeding part 100 is exemplified as the inclination part, but the present invention is not limited to this, and the sheet conveyer may be the inclination part, for example.

Figure 12:
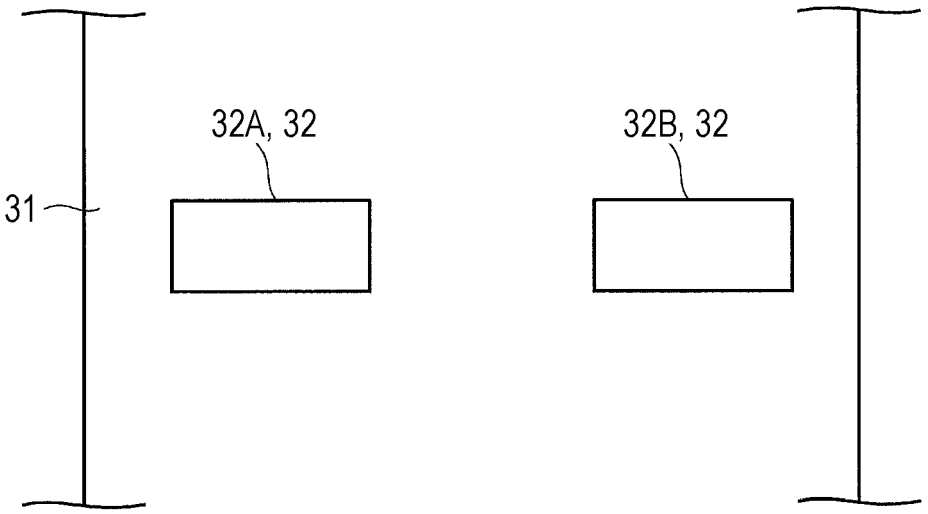
FIG. 12 is a view showing an example of a conveying path part having two conveyance rollers.

For example, as shown in FIG. 12, a configuration is assumed in which the sheet conveyer has a pair of conveyance rollers 32 at positions respectively corresponding to both ends of the sheet S in the width direction, in a conveying path part 31 that goes from the sheet feeding part to a metal drum portion. In this configuration, the sheet S may be inclined by making a difference in conveyance speeds of a conveyance roller 32A on one side and a conveyance roller 32B on another side.

In addition, a configuration is assumed in which a blowing unit that blows air is provided on each of the both ends of the sheet S in the width direction on a conveying surface of the conveying path part 31. In this configuration, the sheet S may be inclined by making an amount of air blow different between one side of the conveyance surface and another side conveyance surface, to cause frictional inclination on the conveyance surface.

Figure 13:
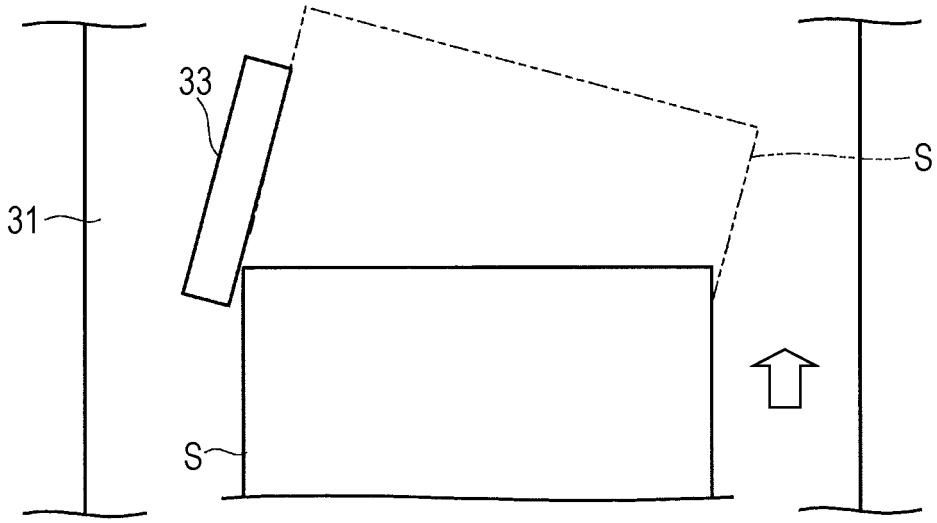
FIG. 13 is a view showing an example of a configuration having a sheet-orientation correcting member.

Further, as shown in FIG. 13, a configuration is assumed in which a sheet-orientation correcting member 33 is provided in the conveying path part 31. The sheet-orientation correcting member 33 is erected so as to be higher than a thickness of the sheet S on the conveyance surface of the conveying path part 31, for example. The sheet-orientation correcting member 33 is inclined with respect to the conveyance direction. Specifically, the sheet-orientation correcting member 33 is arranged at a left end portion in FIG. 13, and is inclined so as to be positioned to the right as going upward.

The sheet S (see a solid line) that is in contact with the sheet-orientation correcting member 33 is inclined following the inclination of the sheet-orientation correcting member 33 (see a two-dot chain line). The sheet S may be inclined in this way.

Further, the sheet-orientation correcting member 33 has a configuration of being retractable to a position where the sheet S does not come into contact with so as not to hinder the conveyance of the sheet S after contact of the sheet S. An example of the sheet-orientation correcting member 33 being retractable is a configuration in which the sheet S is retracted to outside in the width direction.

Further, the sheet-orientation correcting member may be a movable projection member such as a pin. The projection member may simply be provided, for example, one each so as to be able to abut with both side ends of the sheet S in the width direction, and to be able to incline the sheet S by abutting with and positioning both side ends.

Figure 14:
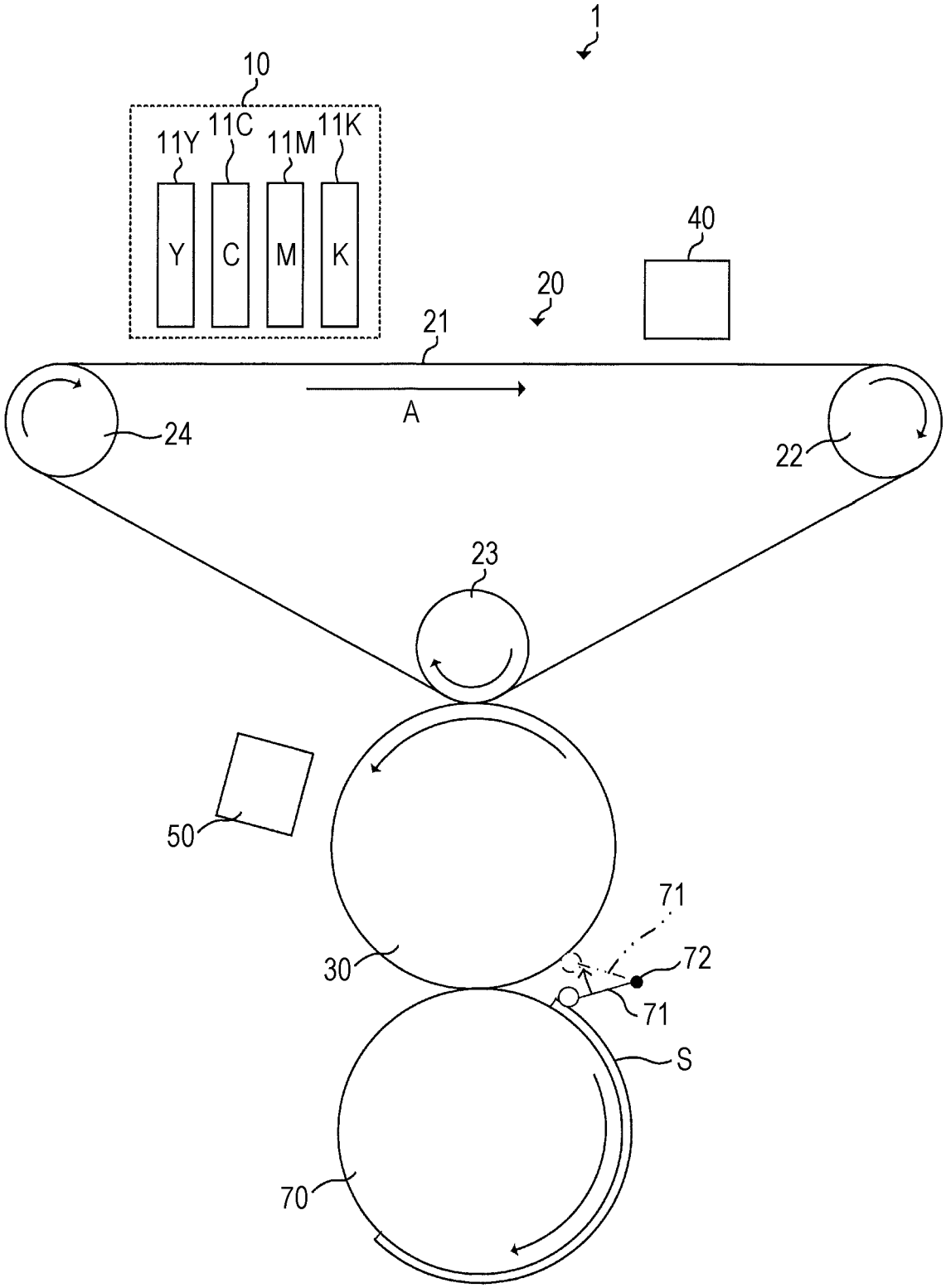
FIG. 14 is a view schematically showing an overall configuration of an image forming apparatus having a reversing part.

Further, in the above-described embodiment, one side of the sheet S is exclusively printed, but the image forming apparatus 1 may be capable of printing both sides, for example, as shown in FIG. 14.

The image forming apparatus 1 has a reversing part 70 in addition to the configuration shown in FIG. 1. The reversing part 70 is formed by a metal drum, and is located on an opposite side of the sheet conveyer 30 from the intermediate transfer belt 21. An arm part 71 is provided on a downstream side of a nip part between the reversing part 70 and the sheet conveyer 30.

The arm part 71 is made rotatable around a rotation shaft 72, and a leading end portion is adapted to move between a portion corresponding to the reversing part 70 and a portion corresponding to the sheet conveyer 30. The arm part 71 is provided at a position corresponding to, for example, both ends of the sheet S in the width direction.

A sheet S having an image formed on a front surface is conveyed on the sheet conveyer 30, and the reversing part 70 receives the sheet S at a portion of a nip part formed between the sheet conveyer 30 and the reversing part 70. When the reversing part 70 rotates, the sheet S is sucked by the reversing part 70 and conveyed on the reversing part 70. At this time, the front surface of the sheet S faces the reversing part 70, and thus the sheet S is reversed.

Then, when a rear end of the sheet S reaches a position coming out from the nip part, a rear surface at the rear end is sucked or nipped by the arm part 71, and the rear end is conveyed to a position corresponding to the sheet conveyer 30. This causes the sheet S to be sucked by the sheet conveyer 30 such that the rear surface of the sheet S is to be the front side. Therefore, the rear surface of the sheet S is conveyed to the position of the transfer nip, and an image is transferred to the rear surface.

In such a configuration, when the sheet S is made inclined, the sheet S can be inclined by making a mutual difference in conveyance speeds of the respective arm parts 71 corresponding to both ends of the sheet S in the width direction.

Further, when the sheet S is sucked and conveyed by the reversing part 70, the sheet S may be inclined by changing a suction area on the reversing part 70 so that the sheet S has a desired inclination angle.

Further, when the sheet S is inverted by the reversing part 70, the sheet S enters the transfer nip from the rear end side. Therefore, the controller 200 controls the ink ejecting part 10 such that the image formed on the intermediate transfer belt 21 has inclination that matches the inclination of the inverted sheet S.

This allows an image to be formed at an appropriate position on the rear surface of the sheet S as well.

Figure 15:
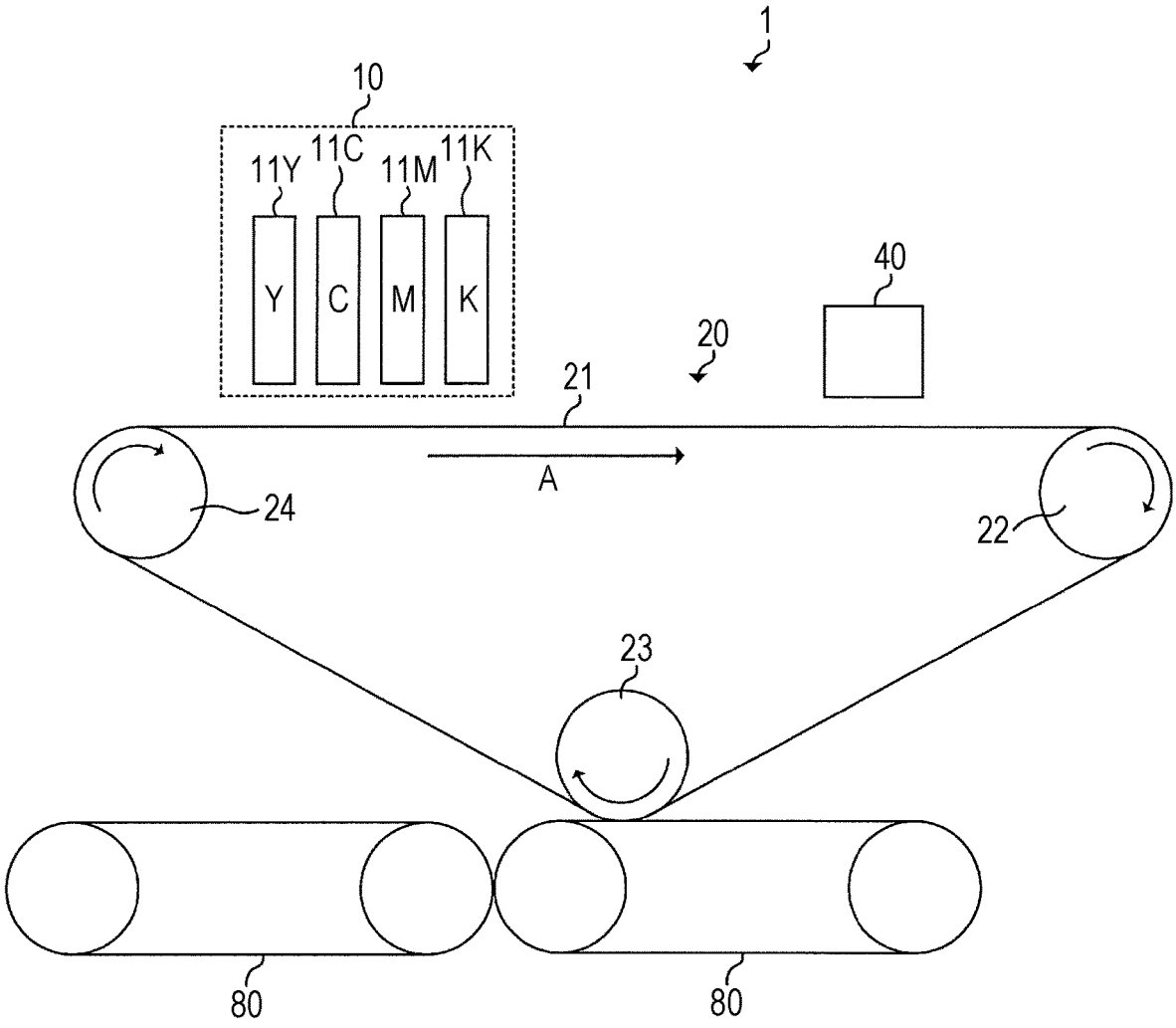
FIG. 15 is a view schematically showing an overall configuration of an image forming apparatus in which a sheet conveyer is a conveyance belt.

Further, the sheet conveyer 30 is formed by a metal drum in the above-described embodiment, but the present invention is not limited to this. For example, as shown in FIG. 15, a plurality of continuous endless conveyance belts 80 may be provided.

Even with such a configuration, since the sheet S is conveyed in an inclined state, the sheet S can be conveyed so as to transfer from a leading corner of the sheet S between the conveyance belts 80.

If the sheet S is conveyed without inclination, the leading end of the sheet S is to be the entire short side portion of the sheet S, which causes the leading end of the sheet S to be likely to hang down between the conveyance belts 80. However, in the present embodiment, since the sheet S is conveyed in an inclined state, a leading portion of the sheet S becomes lightweight, which makes it possible to suppress hanging down of the leading portion of the sheet S, and thus enables smooth conveyance of the sheet S.

Further, the transfer part includes a belt member such as an intermediate transfer belt in the above-described embodiment, but the present invention is not limited to this, and may have a configuration including a drum member capable of simultaneously performing image formation and transfer.

Figure 16:
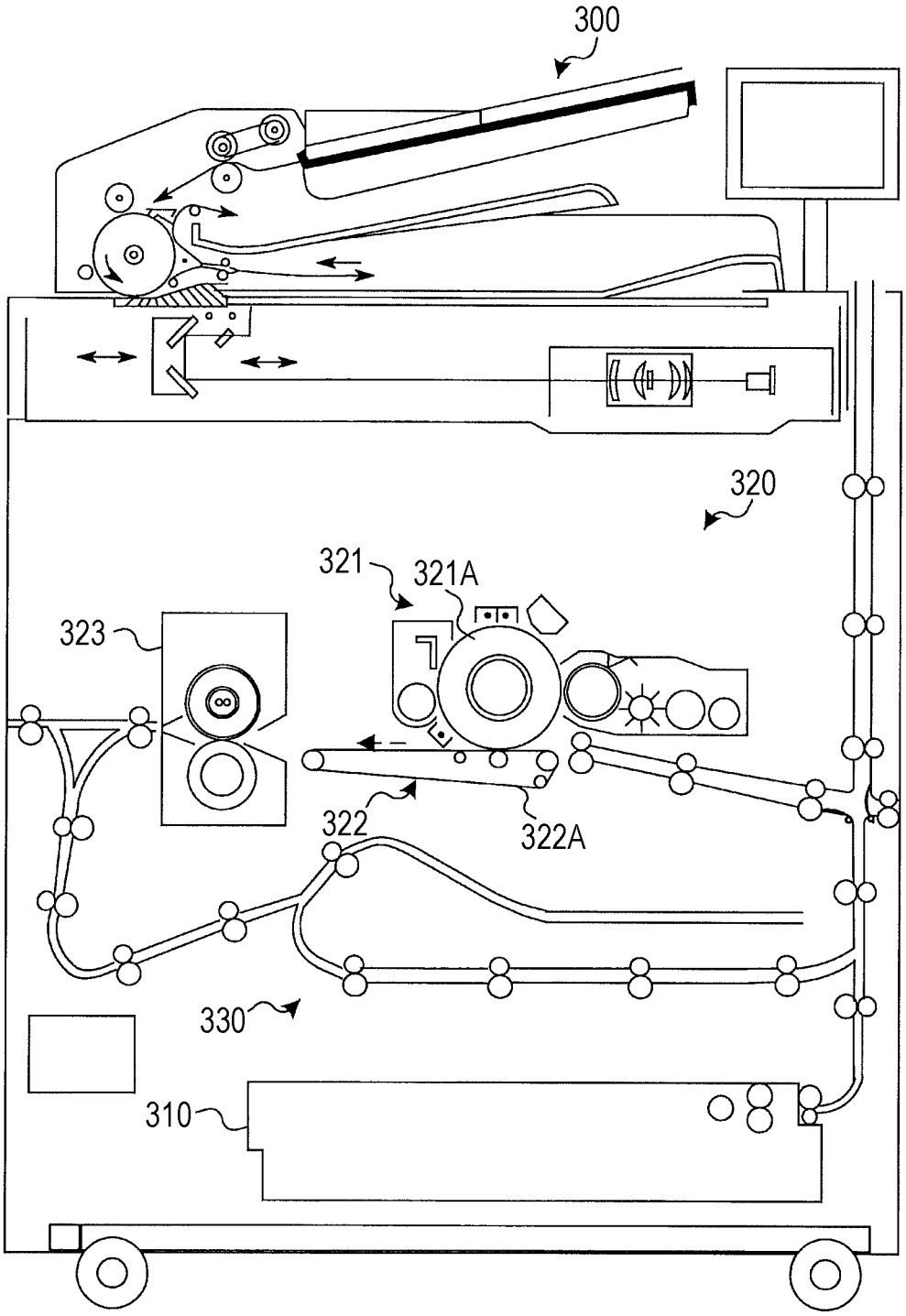
FIG. 16 is a view schematically showing an overall configuration of an electrophotographic image forming apparatus.

Further, the image forming apparatus that forms an image based on the inkjet method is used in the above-described embodiment, but the present invention is not limited to this. For example, as shown in FIG. 16, the image forming apparatus 300 may include an image former 320 that forms an image based on an electrophotographic method.

Specifically, the image forming apparatus 300 is a direct-transfer monochrome image forming apparatus using an electrophotographic process technology. That is, the image forming apparatus 300 forms an image by directly transferring, onto a sheet, a K component (black) toner image formed on a photosensitive drum 321A.

The image forming apparatus 300 includes a sheet feeding part 310, the image former 320, a sheet conveyer 330, and the like. Note that the sheet feeding part 310, the sheet conveyer 330, and the like have known configurations, and thus description thereof will be omitted.

The image former 320 includes a toner image former 321 that forms a toner image by toner of K component on the basis of input image data, a conveyer 322 that conveys a sheet onto which the toner image formed by the toner image former 321 is transferred, a fixing part 323 that fixes the toner image transferred onto the sheet, and the like.

The toner image former 321 includes an exposure device, a charging device, the photosensitive drum 321A, a developing device, and the like.

The photosensitive drum 321A is formed by a drum member, and conveys an image to be transferred onto a recording medium, toward a transfer nip described later. Since other configurations of the toner image former 321 are known configurations, detailed description thereof will be omitted.

The conveyer 322 includes a conveyance belt 322A and the like.

The conveyance belt 322A is formed by an endless belt, and is stretched around the plurality of support rollers in a loop. Between the conveyance belt 322A and the photosensitive drum 321A, the transfer nip is formed. Since other configurations of the conveyer 322 are known configurations, detailed description thereof will be omitted.

The fixing part 323 fixes a toner image on a sheet on which the toner image is formed. Since a configuration of the fixing part 323 is known, detailed description thereof will be omitted.

Even with such a configuration, inclining and conveying a sheet makes it possible to reduce a fluctuation amount of a load applied to the entire transfer nip as compared with a sheet that is not inclined. Therefore, it is possible to reduce unevenness in a conveyance speed of the photosensitive drum 321A due to the load fluctuation. As a result, even when an image is being formed on the photosensitive drum 321A at the timing when the sheet S reaches the transfer nip, it is possible to suppress disturbance on the image.

Although embodiments of the present invention have been described and illustrated in detail, the disclosed embodiments are made for purposes of illustration and example only and not limitation. The scope of the present invention should be interpreted by terms of the appended claims, and the technical scope of the present invention should not be construed in a limited manner by these. That is, the present invention can be implemented in various forms without departing from the scope or main features of the present invention.

What is claimed is:

1. An image forming apparatus comprising:

a conveyer that conveys a recording medium;

a transfer part that forms a transfer nip with the conveyer, and conveys, toward the transfer nip, an image to be transferred onto the recording medium; and an inclination part that inclines the recording medium conveyed by the conveyer with respect to a conveyance direction of the recording medium in the conveyer, the inclination part includes: a sheet-orientation correcting member arranged on a lateral side of a path of the recording medium and inclined relative to the conveyance direction; or movable projection members abuttable with side ends of the recording medium for positioning the side ends to incline the recording medium.

2. The image forming apparatus according to claim 1, wherein the inclination part inclines the recording medium before entering the transfer nip.

3. The image forming apparatus according to claim 1, further comprising:

an image former that forms the image with inclination on the transfer part in accordance with orientation of the recording medium inclined by the inclination part.

4. The image forming apparatus according to claim 3, wherein the image former forms, on the transfer part, the image with inclination at an inclination angle same as an inclination angle of the recording medium inclined by the inclination part with respect to the conveyance direction.

5. The image forming apparatus according to claim 3, wherein the image former forms an image based on an inkjet method.

6. The image forming apparatus according to claim 3, wherein the image former forms an image based on an electrophotographic method.

7. The image forming apparatus according to claim 1, wherein as at least one of a basis weight or a thickness of the recording medium increases, the inclination part increases an inclination angle of the recording medium with respect to the conveyance direction.

8. The image forming apparatus according to claim 7, further comprising a controller that calculates the inclination angle based on at least one of a basis weight or a thickness of the recording medium.

9. The image forming apparatus according to claim 8, wherein the controller generates image data based on the calculated inclination angle.

10. The image forming apparatus according to claim 1, further comprising:

a reversing part that reverses the recording medium to allow an image to be transferred to a rear surface of the recording medium, wherein the inclination part inclines the recording medium reversed by the reversing part.

11. The image forming apparatus according to claim 1, wherein the transfer part includes a belt member.

12. The image forming apparatus according to claim 1, wherein the transfer part includes a drum member.

13. The image forming apparatus according to claim 1, wherein the inclination angle is adjusted in response to a user operation.

14. The image forming apparatus according to claim 1, wherein the inclination part includes the sheet-orientation correcting member.

15. The image forming apparatus according to claim 1, wherein the inclination part includes the movable projection members.

16. A conveyance control method for an image forming apparatus comprising: a conveyer that conveys a recording medium; and a transfer part that forms a transfer nip between with the conveyer, the method comprising:

conveying an image to be transferred to the recording medium, toward the transfer nip; and inclining the recording medium conveyed by the conveyer with respect to a conveyance direction of the recording medium in the conveyer, wherein the recording medium is inclined using an inclination part including a sheet-orientation correcting member arranged on a lateral side of a path of the recording medium and inclined relative to the conveyance direction; or movable projection members abuttable with side ends of the recording medium for positioning the side ends to incline the recording medium.

* * * * *